US007597786B2

(12) United States Patent
Kivistö et al.

(10) Patent No.: US 7,597,786 B2
(45) Date of Patent: Oct. 6, 2009

(54) TRANSFER AND INSULATION DEVICE FOR ELECTROLYSIS

(75) Inventors: Tuomo Kivistö, Jorvas (FI); Tom Marttila, Espoo (FI)

(73) Assignee: Outotec Oyj, Espoo (FI)

( * ) Notice: Subject to any disclaimer, the term of this patent is extended or adjusted under 35 U.S.C. 154(b) by 558 days.

(21) Appl. No.: 10/509,524

(22) PCT Filed: Mar. 20, 2003

(86) PCT No.: PCT/FI03/00215

§ 371 (c)(1),
(2), (4) Date: Sep. 28, 2004

(87) PCT Pub. No.: WO03/083179

PCT Pub. Date: Oct. 9, 2003

(65) Prior Publication Data

US 2005/0145481 A1 Jul. 7, 2005

(30) Foreign Application Priority Data

Apr. 3, 2002 (FI) ..... 20020635

(51) Int. Cl.
*B23H 3/04* (2006.01)

(52) U.S. Cl. ..... 204/286.1; 204/297.01; 204/275.1; 204/278.5

(58) Field of Classification Search ..... 204/207, 204/208, 225, 226, 227, 275.1, 278.5, 286.1, 204/297.01
See application file for complete search history.

(56) References Cited

U.S. PATENT DOCUMENTS

| | | | | | |
|---|---|---|---|---|---|
| 3,997,421 | A | | 12/1976 | Perri et al. | 204/267 |
| RE30,005 | E | * | 5/1979 | Harvey et al. | 205/578 |
| 4,279,731 | A | | 7/1981 | Pellegri | 204/254 |
| 4,619,751 | A | | 10/1986 | Robinson | 204/267 |
| 5,002,642 | A | | 3/1991 | Kaneko et al. | 204/105 |
| 5,534,048 | A | * | 7/1996 | Dailey et al. | 106/1.22 |
| 6,099,600 | A | * | 8/2000 | Yan et al. | 29/25.03 |
| 6,193,863 | B1 | * | 2/2001 | Kobayashi | 204/288.3 |
| 6,231,730 | B1 | * | 5/2001 | Davis et al. | 204/279 |
| 6,342,136 | B1 | * | 1/2002 | Virtanen et al. | 204/242 |
| 6,962,649 | B2 | * | 11/2005 | Wilson et al. | 204/224 R |
| 2004/0087838 | A1 | * | 5/2004 | Galloway et al. | 600/300 |

* cited by examiner

*Primary Examiner*—Bruce F Bell
(74) *Attorney, Agent, or Firm*—Locke Lord Bissell & Liddell LLP; Brandon T. Schurter

(57) ABSTRACT

The invention relates to a transfer and insulation device (1) for electrically insulating electrodes, particularly anodes (2) and cathodes (3), used in the electrolytic cleaning of metals, from each other in an electrolytic tank (4), for distributing the electrodes as they are hanging in the electrolytic tank and for enabling the electrodes to be transferred, said transfer and insulation device (1) being made of one single piece.

6 Claims, 2 Drawing Sheets

TRANSFER AND INSULATION DEVICE FOR ELECTROLYSIS

CROSS-REFERENCE TO RELATED APPLICATION

This is a U.S. national phase patent application of the PCT application No. PCT/F103/00215 filed on Mar. 20, 2003 that claims priority from Finish patent application no. 20020635 filed on Apr. 3, 2002, both of which are incorporated by reference.

FIELD OF THE INVENTION

The invention relates to a transfer and insulation device, made from one single piece, for electrically insulating electrodes, particularly anodes and cathodes, used in the electrolytic cleaning of metals in the electrolytic tank, for distributing electrodes as they are hanging in the electrolytic tank and for enabling the electrodes to be transferred.

BACKGROUND OF THE INVENTION

In an electrolytic plant meant for electrolytically cleaning metals such as copper, zinc and nickel, there is typically a large number of electrolytic tanks that are in groups connected in series, so that the anode of the preceding tank is electrically connected to the cathode of the next tank by means of a highly electroconductive conductor rail that is placed on the wall between the tanks and is generally made of copper. This coupling is called a walker system. Said structure typically also includes a notched insulation rail placed on the conductor rail, which insulation rail separates the cathode of the preceding tank from the conductor rail of the anode of the next tank. Without said insulation, all electrodes of all tanks would be electrically connected, and current would not pass through the electrolyte.

The anodes and cathodes serving as electrodes are placed in an alternating fashion in the electrolytic tank. In order to perform the electrolytic cleaning in an advantageous way, the electrodes are placed as near to each other as possible, and consequently the mutual positioning of the electrodes must be carried out carefully in order to avoid short circuits. In connection with loading in the tank, separate loading elements approach the tank walls and the conductor rails resting on the tank together with their insulations, so that even small errors in the movements of a loading element may damage the tanks, the conductor rails or the insulations. Therefore the gripping spot of the electrodes should be such that the loading element could grip it as easily as possible, and that the chances for erroneous movements would be minimized.

A known way to arrange the distribution of electrodes in the tank is either to provide the electrode supporting elements with notching on the side by which they are placed on the conductor rail, or by notching the conductor rail so that the supporting elements supporting the electrode are set in notches provided for them. One possibility is to arrange the distribution of electrodes by notching the insulation rail provided in connection with the conductor rails. By notching the structures where the electrodes are hanging, it is also possible to prevent contacts between adjacent electrodes.

When electrodes are lifted from the tank in order to change their position, the electrodes are generally gripped at the notchings made underneath the support elements thereof, by means of the hooks of a transfer arrangement, such as a crane. Generally the support elements are also provided with separate transfer lugs that are gripped by the lifting hook of the transfer arrangement.

For instance from the U.S. Pat. No. 3,682,809 there is known a conductor rail arrangement where the conductor rail is uniform in structure, and the support elements supporting the electrodes are notched on the side where they are set on the conductor rails.

The prior art solutions have following drawbacks. The manufacturing of a notched conductor rail, generally extending over the whole tank, is expensive. On the other hand, if the employed rail is not notched, the electrodes are set in an inclined position owing to the insulation rail. Also the manufacturing of notched electrodes is expensive, and when immersing them in the tank, they must be lowered at exactly the right spot with respect to the conductor rail, when seen in the transversal direction of the tank. This requires extraordinary precision of the transfer operation. Owing to the notched insulation rail and possibly also owing to the conductor rail, the electrodes must be lowered in the tank at exactly the right spot with respect to the conductor rail, in order to make the electric contacts and separations to be correctly created. A possible heat extension of the conductor rail may cause problems while using an automatic crane, because when replacing electrodes, the heat extension of a conductor rail may shift the electrode positions, i.e. the notches. If a notched conductor rail is used, the electrode distribution cannot be changed without replacing all conductor rails and insulation rails. Because of the notched insulation rail, in practice the cleaning of the conductor rail always requires that the insulation rail is removed for the duration of the cleaning. This makes cleaning, particularly mechanized cleaning, more difficult. A notched rail must be made relatively thin, wherefore it generally becomes fairly weak and short-lived.

SUMMARY OF THE INVENTION

The object of the present invention is to introduce a novel arrangement for electrically insulating electrodes, particularly anodes and cathodes, from each other in an electrolytic tank, for distributing anodes and cathodes in an electrolytic tank and for enabling the electrodes to be transferred. In particular, the object of the invention is to combine the aforementioned functions in one and the same piece.

The invention is characterized as a transfer and insulation device which is made of one single piece comprising a transfer portion and an insulation portion used for electrically insulating electrodes from each other in an electrolytic tank, for distributing the electrodes as they are hanging in the electrolytic tank and for enabling the electrodes to be transferred in the electrolytic cleaning of metals. In one embodiment the transfer and insulation device is made of a chemically resistant and insulating material. In another embodiment the transfer and insulation device is made of plastic. In yet another embodiment the transfer and insulation device is attached to a suspension rod of an electrode, on both sides of the electrode, essentially at an equal distance from the wall of the electrolytic tank, wherein such electrode suspension rod has preferably a fastening point for fastening the transfer and insulation device. In a further embodiment the transfer and insulation device surrounds part of the electrode suspension rod. In another embodiment, the transfer and insulation device only extends over a part of the width of the electrode. In yet another embodiment, the transfer and insulation device is provided with a grip lug for enabling the electrode to be transferred. In one embodiment, the device is arranged in the suspension rod of the electrode so that the grip lug extends towards the middle part of the electrode. In another embodiment, the grip lug is provided with an inclined part for adjusting the position of the gripping hooks transferring the electrode. In another embodiment, the transfer and insulation device includes a distribution element for insulating adjacent electrodes from each other. In yet another embodiment, the electrode is an anode.

Remarkable advantages are achieved by the transfer and insulation device according to the invention. According to the invention, by means of a device made of one single piece, the electrodes, particularly anodes and cathodes, used in the electrolytic cleaning of metals are advantageously electrically insulated from each other in one and the same electrolytic tank, and the adjacent anodes and cathodes are distributed evenly as they are hanging in connection with the conductor rail structure of the electrolytic tank. In addition, the electrodes are transferred by means of a gripping lug provided in the device. Advantageously the device according to the invention is made of a chemically resistant and heat-resistant insulating material, such as plastic, which makes it possible to be used in electrolysis. The device is manufactured for instance by pressurized casting.

The transfer and insulating device according to the invention is advantageously arranged in connection with the anode suspension rod. The transfer and insulation device is attached by fastening elements, such as locking pins, to the fastening point of the anode rod. Advantageously at both ends of the anode suspension rod, there is installed one transfer and insulation device so that each separate device is located at an equal distance from the tank wall. In the transversal direction, the transfer and insulation device only extends to a part of the anode width. The anode suspension rod is partly surrounded by the device, in which case the fastening element fastening the device passes, in the lengthwise direction of the tank, through both the suspension rod and the transfer and insulation device. The anode hangs in the conductor rail structure, suspended by the suspension rod.

Advantageously the transfer and insulation device is designed so that it is easy to grip by a transfer hook of the electrode transfer device or by a corresponding transfer element. The device includes a grip lug, and the anode is advantageously lifted and lowered without swinging, when it is gripped at said lug. Advantageously the device is placed so that the grip lug is oriented towards the center part of the anode, so that the transfer hooks of the transfer arrangement are easily attached at the lugs. The grip lug is provided with an inclined part that helps the crane transfer hook to slip in the right spot in the grip lug, so that the lifting of the electrode is carried out successfully. Separate transfer lugs conventionally made in anodes are replaced by grip lugs provided in the device according to the invention.

In order to avoid short circuits, adjacent anodes and cathodes must not get into contact in the tank. The distribution element of the device advantageously prevents the anodes and cathodes from touching each other in the tank, and it distributes the electrodes at even distances and at the same height in the tank. Thus it is unnecessary to provide notches in the conductor rail structure in order to ensure that the electrodes are placed equidistantly. When lowering an anode in the tank, in case of a possible erroneous movement in the sideways direction, the end of the suspension rod is prevented from touching the electroconductive rail or support element of the adjacent electrode, because the distribution element of the device first touches the tank wall and thus prevents the end from touching the rail. Remarkable savings in the expenses of the electrolytic process are achieved by using the transfer and insulation device according to the invention, and automatic transfer processes of the electrodes are made much easier. By means of the device according to the invention, a device made of one single piece is provided with several functions that earlier were replaced for example by notching the conductor rail structure and by providing the anodes with lifting lugs. Advantageously the device is designed so that when lowering a cathode beside an anode, any mutual contact between them is prevented.

BRIEF DESCRIPTION OF THE DRAWINGS

The invention is described in more detail below with reference the appended drawings.

DETAILED DESCRIPTION OF THE INVENTION

Figure 1:
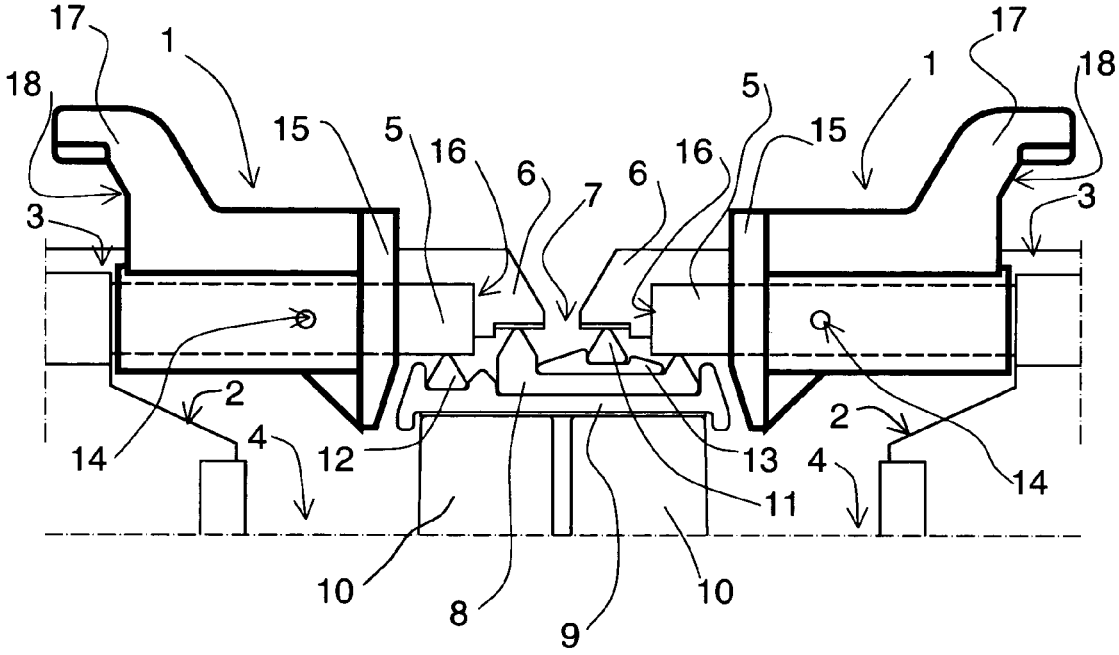
FIG. 1 A cross-sectional illustration showing adjacent electrolytic tanks and a transfer and insulation device according to the invention.

According to FIG. 1, the anodes 2 and cathodes 3 are lowered into electrolytic tanks 4, of which only two adjacent tanks are illustrated. In reality, an electrolytic process includes a large number of adjacent tanks, where similar structures are repeated. According to the drawing, the anodes 2 and cathodes 3 are placed in the tank 4 in succession, in an alternating order, in the lengthwise direction of the tank. The drawing shows first an anode at the front, and behind the anode, a cathode that is located further up. Both the anodes and the cathodes are suspended, by means of their suspension rods 5 and 6, in conductor rail structures 7 placed on top of the walls 10 of the electrolytic tank 4. The conductor rail structure comprises a conductor rail 8 extending over the whole length of the tank in order to electrically connect the anode and the cathode of adjacent tanks, and an insulation sheet 9 of the same length as the tank, placed between the conductor rail and the wall 10. In addition, the structure 7 comprises support elements 11 and 12 for those electrodes that are not connected to the conductor rail 8, and an insulation profile 13 in order to insulate the other support element from the conductor rail.

The transfer and insulation device 1 illustrated in FIG. 1 is at the fastening point 14 attached at both ends of the suspension rod 5 of the anode 2 by means of a locking pin or the like, so that the locking pin passes through the suspension rod and the device in the lengthwise direction of the tank. Only one end of the anode and the cathode is illustrated in FIG. 1. When the transfer and insulation device is placed in the anode 2, its suspension rod 5 passes through the device 1. The transfer and insulation devices are arranged at the anode ends, so that they are located equidistantly from the tank walls 10, and that the device extends to only a part of the width of the anode 2. When lowering an anode into the tank 4, the distribution element 15 may touch the tank wall, but in any case the end 16 of the suspension rod 5 is prevented from touching the electroconductive rail or support element of the adjacent electrode. The grip lug 17 of the device extends towards the middle part of the tank, and the inclined part 18 thereof helps the transfer element hook to find the right spot when gripping the anode in order to transfer it.

Figure 2:
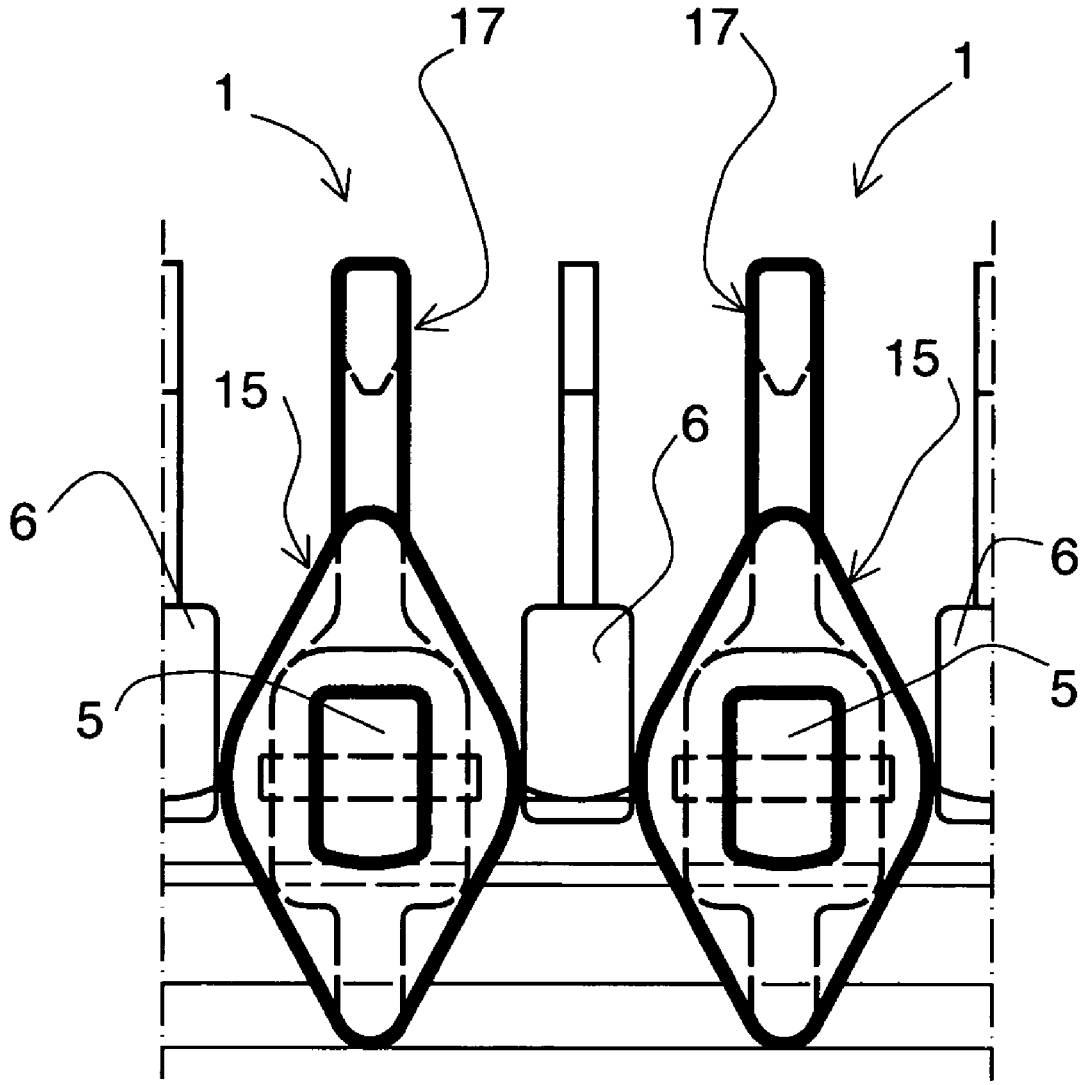
FIG. 2 A cross-sectional illustration of a transfer and insulation device according to the invention.

FIG. 2 is a cross-sectional illustration of FIG. 1 and shows two adjacent transfer and insulation devices 1 according to the invention when seen from the side. According to FIG. 2, seen from the grip lug 17 down to the distribution element 15, the transfer and insulation device 1 is straight in form, but it may as well be round or angular. As is seen in FIG. 2, the distribution element 15 of the device 1 prevents adjacent electrodes from touching each other in the tank and distributes the electrodes evenly and at the same height as they are hanging in the tank. The suspension rods 6 of the cathodes remain between the distribution elements 15, and the suspension rods 5 of the anodes pass through the transfer and insulation device 1.

For a man skilled in the art, it is obvious that the various embodiments of the invention are not restricted to the above described examples only, but may vary within the appended claims.

The invention claimed is:

1. A device comprising a transfer portion and an insulation portion, wherein said device is one single piece and wherein the insulation portion is attachable to an electrode and the device is supported by an anode suspension rod and the device has a fastening point for fastening the insulation portion to an end of the anode suspension rod and the insulation portion at least partly surrounds the anode suspension rod that passes through the device.

2. The device according to claim 1, wherein the device is made of a chemically resistant and insulating material.

3. The device according to claim 2 wherein the device is made of plastic.

4. The device according to claim 1, wherein the transfer portion is provided with a grip lug for enabling the electrode to be transferred.

5. The device according to claim 4 wherein the grip lug is provided with an inclined part for adjusting the position of the gripping hooks transferring the electrode.

6. The device according to claim 1, wherein the device includes a distribution element for insulating adjacent electrodes from each other.

* * * * *